US006623405B2

(12) United States Patent
Chuang et al.

(10) Patent No.: US 6,623,405 B2
(45) Date of Patent: Sep. 23, 2003

(54) WRIST EXERCISER WITH MESSAGE DISPLAY

(76) Inventors: Yun Yu Chuang, 4F., No. 16, Alley 15, Lane 82, Da Yong Street, San Chong City, Taipei (TW); Ming Hung Lin, 2F., No. 24, Lane 178, Li Shyng Road Section 1, San Chong City, Taipei (TW)

( * ) Notice: Subject to any disclaimer, the term of this patent is extended or adjusted under 35 U.S.C. 154(b) by 0 days.

(21) Appl. No.: 10/051,133

(22) Filed: Jan. 22, 2002

(65) Prior Publication Data

US 2003/0139256 A1 Jul. 24, 2003

(51) Int. Cl.[7] ..... A63B 5/00
(52) U.S. Cl. ..... 482/44; 482/45; 601/33
(58) Field of Search ..... 482/1, 2, 4, 5, 482/44, 45, 49, 50, 92, 106, 108, 135–137, 902; 601/23, 33, 40

(56) References Cited

U.S. PATENT DOCUMENTS 5,800,311 A * 9/1998 Chuang ..... 482/44
6,053,846 A * 4/2000 Lin ..... 482/44
6,186,814 B1 * 2/2001 Lin ..... 482/44
6,527,675 B1 * 3/2003 Yu ..... 482/44

* cited by examiner

*Primary Examiner*—Glenn E. Richman
(74) *Attorney, Agent, or Firm*—Rosenberg, Klein & Lee

(57) ABSTRACT

A wrist exerciser includes a spherical hollow casing having a top opening. A ring is received within the casing and substantially coincident with a great circle of the casing. A rotor is rotatably received in the casing by being rotatably supported by the ring. The rotor has a circumferential groove defined in an outer surface thereof for receiving a rope wound around the rope. By manually pulling to unwind the rope through the top opening, the rotor is rotated in the casing. A number of light emitting diodes (LEDs) are arranged on the outer surface of the rotor in a predetermined fashion. A power supply device is mounted to the rotor and electrically connected to the LEDs via a microprocessor based control circuit for conducting on/off the LEDs in accordance with operation modes performed by the microprocessor. By making use of the persistency of human vision, a limited number of the LEDs may display complicated messages, including the rotational speed of the rotor.

18 Claims, 8 Drawing Sheets

WRIST EXERCISER WITH MESSAGE DISPLAY

FIELD OF THE INVENTION

The present invention generally relates to a wrist exerciser for exercising muscles associated with palm and wrist of a person, and wrist and in particular to a wrist exerciser incorporating a message display for displaying messages to the user by means of "visual persistency" of human eyes.

BACKGROUND OF THE INVENTION

A wrist exerciser is generally provided for exercising the muscles associated with the wrist and/or palm of a user which may be done for rehabilitation purposes. Examples of the wrist exerciser are shown in Taiwan Patent No. 135058 and U.S. Pat. No. 5,800,311. Both disclose a wrist exerciser to be held by a user's palm and operated by the user's wrist/palm muscles for exercising the wrist.

These conventional wrist exercisers are commonly regarded as an exercising device, rather than an entertaining device. Thus, generally speaking, they are not very appealing to general consumers. In addition, although some of the conventional wrist exercisers are provided with light and sound generating devices which cause light and sound during the operation of the exercisers, it may be further improved in enhancing visual versatility of attraction to general consumers.

It is thus desirable to provide a wrist exerciser having a more consumer appealing visual versatility.

SUMMARY OF THE INVENTION

Accordingly, an object of the present invention is to provide a wrist exerciser having a message display for providing visual attraction to general consumers.

Another object of the present invention is to provide a wrist exerciser having a message display for showing messages and/or patterns.

A further object of the present invention is to provide a wrist exerciser having a message display comprising a number of particularly arranged light-emitting elements for displaying selected messages during the operation of the exerciser.

To achieve the above objects, in accordance with the present invention, there is provided a wrist exerciser comprising a spherical hollow casing having a top opening. A ring is received within the casing and substantially coincident with a great circle of the casing. A rotor is rotatably supported in the casing by being rotatably supported by the ring. The rotor has a circumferential groove defined in an outer surface thereof for receiving a rope wound around the rope. By manually pulling to unwind the rope through the top opening, the rotor is rotated in the casing. A number of light emitting diodes (LEDs) are arranged on the outer surface of the rotor in a predetermined fashion. A power supply device is mounted to the rotor and electrically connected to the LEDs via a microprocessor based control circuit for conducting on/off the LEDs in accordance with operation modes performed by the microprocessor. By making use of the persistency of human vision, a limited number of the LEDs may display complicated messages, including the rotational speed of the rotor.

BRIEF DESCRIPTION OF THE DRAWINGS

The present invention will be more apparent to those skilled in the art by reading the following description of preferred embodiments thereof, with reference to the attached drawings, in which.

DETAILED DESCRIPTION OF THE PREFERRED EMBODIMENTS

Figure 1:
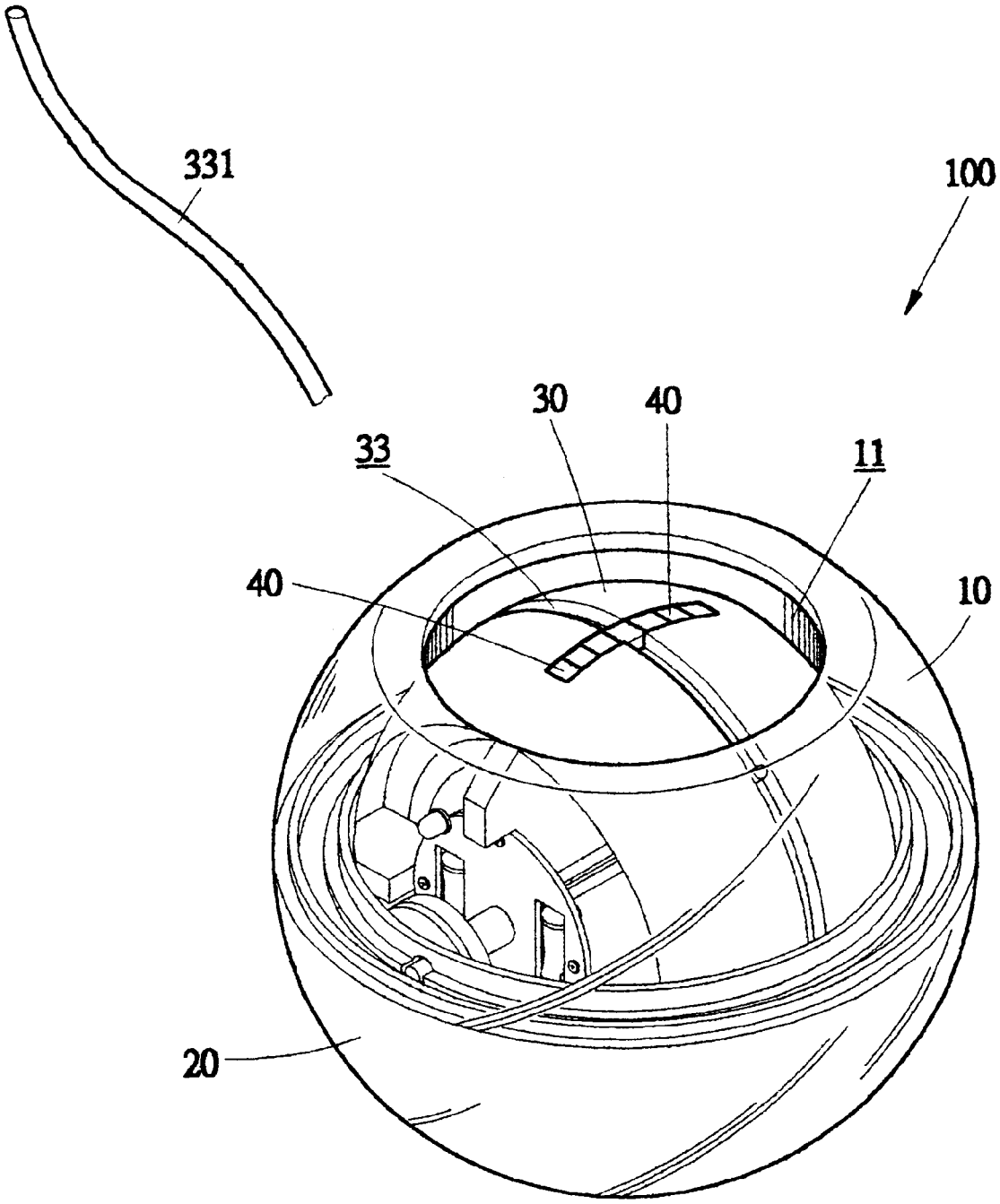
FIG. 1 is a perspective view of a wrist exerciser constructed in accordance with a first embodiment of the present invention.
Figure 2:
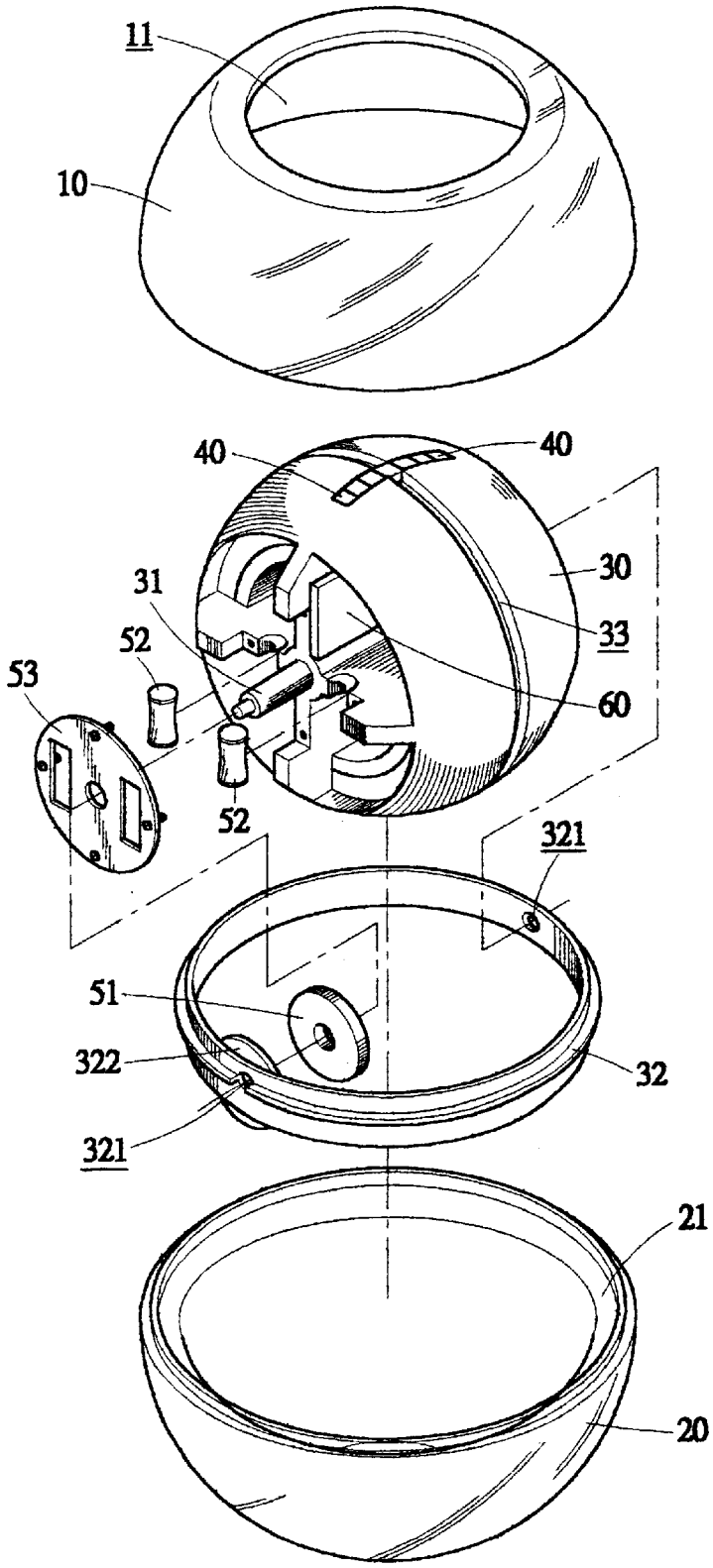
FIG. 2 is an exploded view of FIG. 1.
Figure 3:
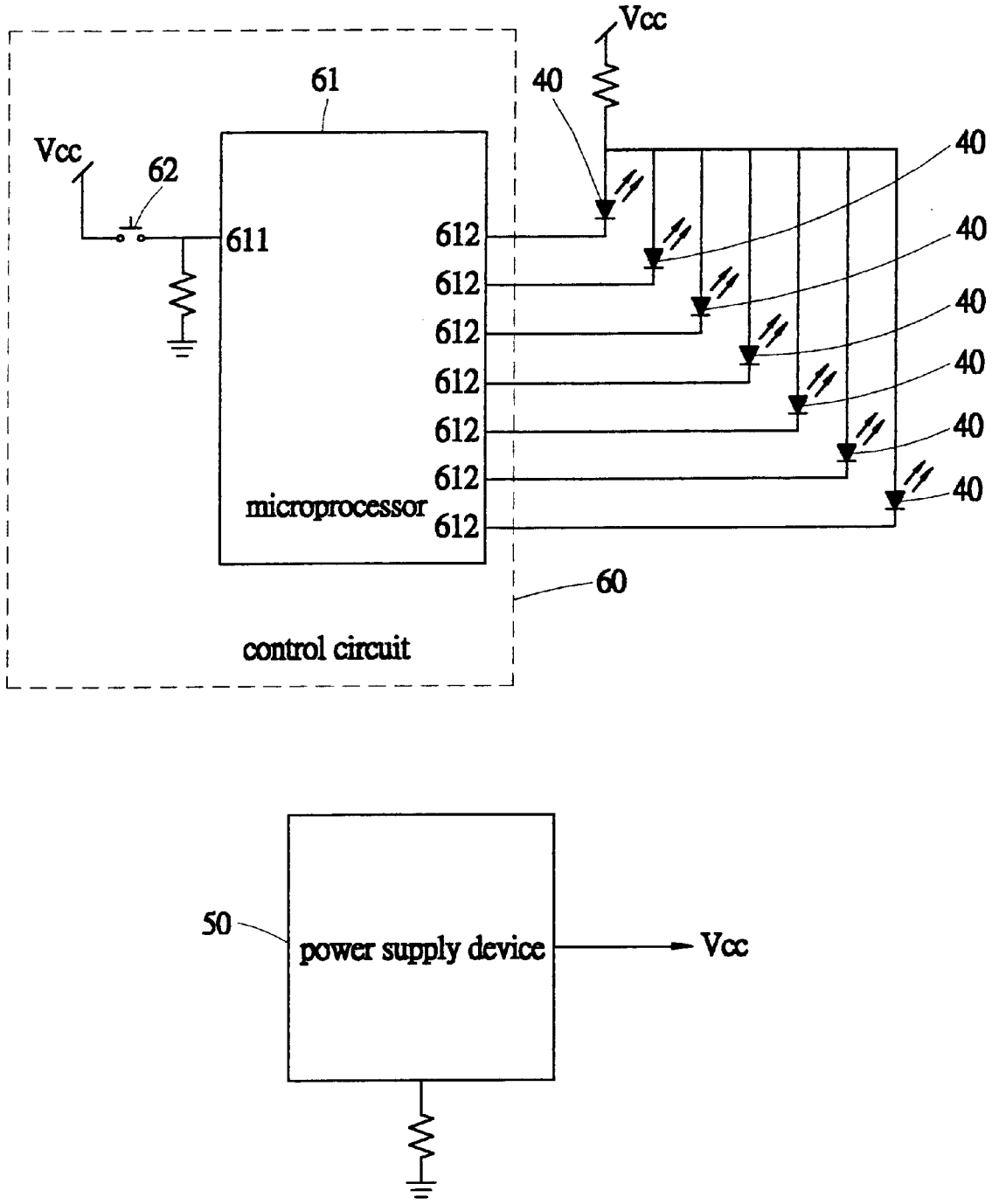
FIG. 3 is a block diagram of a control circuit of the wrist exerciser in accordance with the first embodiment of the present invention.

With reference to the drawings and in particular to FIGS. 1–3, a wrist exerciser constructed in accordance with a first embodiment of the present invention, generally designated with reference numeral 100, comprises a spherical casing constituted by an upper member 10 and a lower member 20 both being substantially hemispheric and attached to each other to form a hollow spherical structure inside which a support ring 32 is received. The ring 32 may be fixed inside the casing (10, 20) or it may be rotatable about a first axis of the spherical casing. A rotor 30 is supported within the ring 32 and is rotatable about a second axis of the spherical casing which is substantially normal to the first axis.

The lower casing member 20 forms an inner circumferential flange 21 on an inner surface thereof and substantially extending along a great circle of the spherical casing of the wrist exerciser 100. The ring 32 is received in the lower casing member 20 and supported by the inner flange 21. If desired, the ring 32 can be made slidable along the flange 21 whereby the flange 21 serves as a race of the ring 32. Alternatively, the ring 32 can be fixed to the flange 21. Two holes 321 are formed in the ring 32 and are diametrically opposite to each other. A magnet support 322 is formed on the ring 32.

The rotor 30 has a spherical outside surface corresponding to and substantially concentric to the spherical configuration of the upper and lower casing members 10, 20 to be rotatably received in the casing. The rotor 30 forms a shaft 31 having two ends extending out of the rotor 30 and rotatably received and retained in the holes 321 of the ring 32 so as to allow the rotor 30 to be rotatable with respect to the ring 32.

The upper casing member 10 is provided with an opening 11 through which a rope 331 (see FIG. 1) can extend into the spherical casing of the wrist exerciser 100. A groove 33 is defined in an outer surface (not labeled) of the rotor 30. The rope 331 can be received in and manually wound around the rotor 30 within the groove 33. By fast pulling to unwind the rope 331 out of the groove 33 with the spherical casing kept stationary, the friction between the rope 331 and the groove 33 drive the rotor 30 to rotate about the shaft 31. It is understood that the rope 331 is only an illustrative example of the ways to rotate the rotor 30. Other means can be employed to rotate the rotor 30 inside the spherical casing.

A plurality of the light emitting elements 40, such as light emitting diodes (LEDs), are mounted to the outer surface of the rotor 30. In an embodiment of the present invention where the casing members 10, 20 are made of an opaque material, the light emitting elements 40 are arranged to pass through the opening 11 of the upper casing member 10 when the rotor 30 is rotating in order to allow visual observation of the light emitting elements 40. In another embodiment of the present invention where at least a portion and preferably the whole of the spherical casing of the wrist exerciser 100 is made of a light transparent material so as to allow visual observation of the light emitting elements 40. The light emitting elements 40 can be arranged in any desired pattern or fashion so that when the rotor 30 is rotating while the light emitting elements 40 are actuated, the user may observe a message or a lightening pattern through for example the opening 11 of the upper casing member 10. In the embodiment illustrated, the light emitting elements 40 are arranged in a line on the outer surface of the rotor 30 substantially along a rotation direction of the rotor 30.

An electrical generator 50, serving as a power supply device, comprises a magnet ring 51 retained by the magnet support 322 of the ring 32 and encompassing the shaft 31 of the rotor 30 to provide a stationary magnetic field. Two coils 52 of conductive wires are attached to the rotor 30 to be rotatable therewith. The coils 52 are arranged to cut through the magnetic line of force of the magnet ring 51 when the rotor 30 is rotating, thus inducing an electrical current in the coils 52. A regulation circuit 53 is connected to the coils 52 for supply of direct current to the light emitting elements 40 thereby providing a power source Vcc (FIG. 3) for the light emitting elements 40.

A control circuit 60 is fixed to the rotor 30. Preferably, the control circuit 60 is received in a cavity (not labeled) defined in the rotor 30. The control circuit 60 is connected to the light emitting elements 40 for controlling the on/off state of the light emitting elements 40. The control circuit 60 can be any circuit capable to control the light emitting elements 40. In the embodiment illustrated, the control circuit 60 comprises a programmable control unit, such as a microprocessor 61, in which software or program for selectively controlling conduction of the light emitting elements 40 in different operation modes is pre-loaded. The microprocessor 61 has an input terminal 611 connected to the regulation circuit 53 or the power source Vcc and a number of output terminals 612 respectively connected to the light emitting elements 40. In the embodiment illustrated, the light emitting elements 40 are LEDs each having two terminals respectively connected to the corresponding output terminal 612 of the microprocessor 61 and the power source Vcc whereby when a low output is present in a particular one of the output terminals 612, the corresponding LED 40 is conducted on. When a high output is present in the output terminal 612, the LED 40 is turned off.

By suitably programming the microprocessor 60, the light emitting elements 40 can be turned on in such a manner to show or display a particular pattern or message.

A switch 62 is connected between the power source Vcc and the input terminal 611 of the microprocessor 61. The switch 62 can allow a user to selectively actuate the control circuit 60. The switch 62 can also function to allow a user to sequentially change among a number of operation modes pre-programmed in the microprocessor 61. Alternatively, the switch 62 can be removed and the operation modes are automatically changed during the rotation of the rotor 30.

Figure 4:
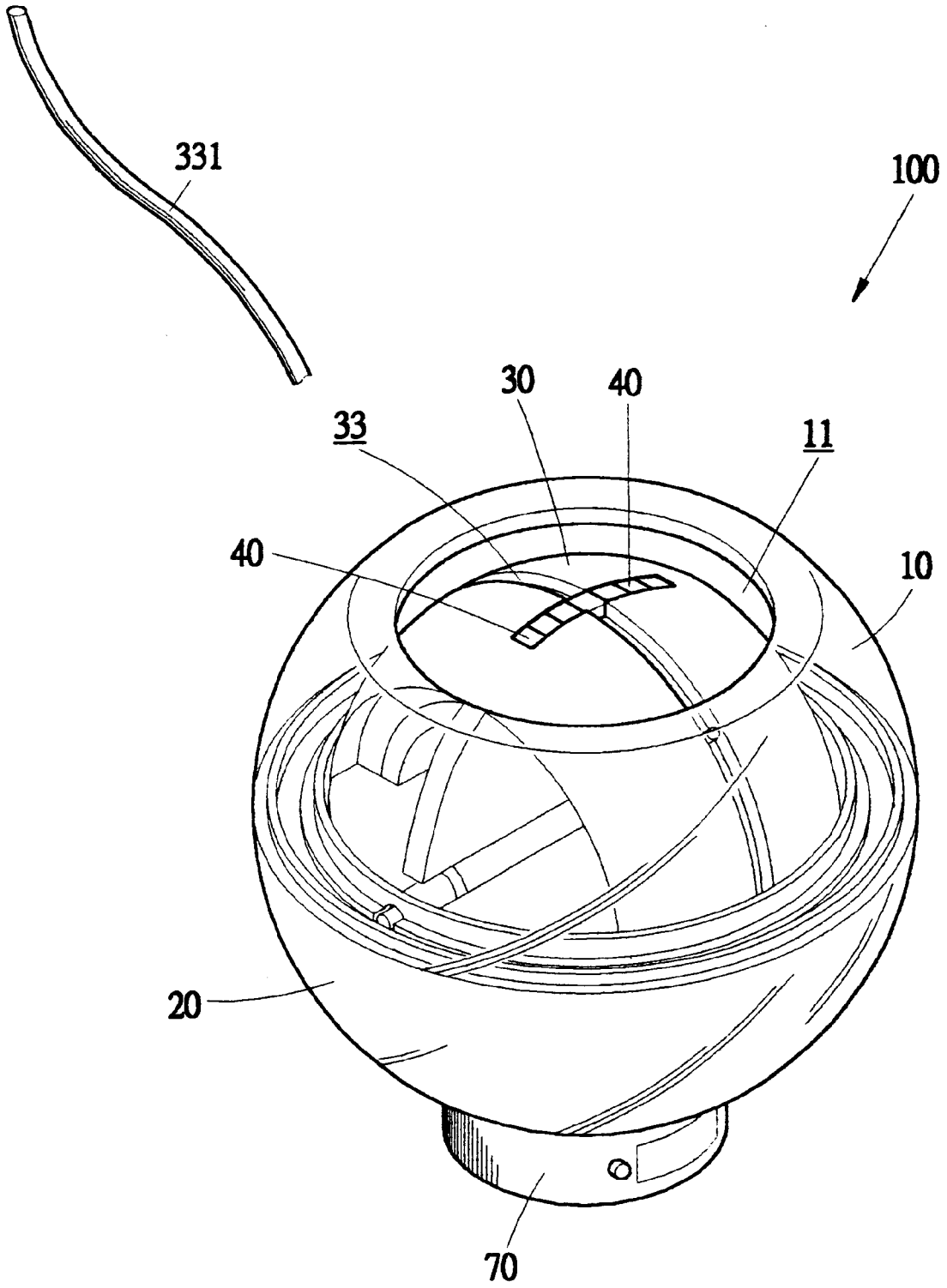
FIG. 4 is a perspective view of a wrist exerciser constructed in accordance with a second embodiment of the present invention.
Figure 5:
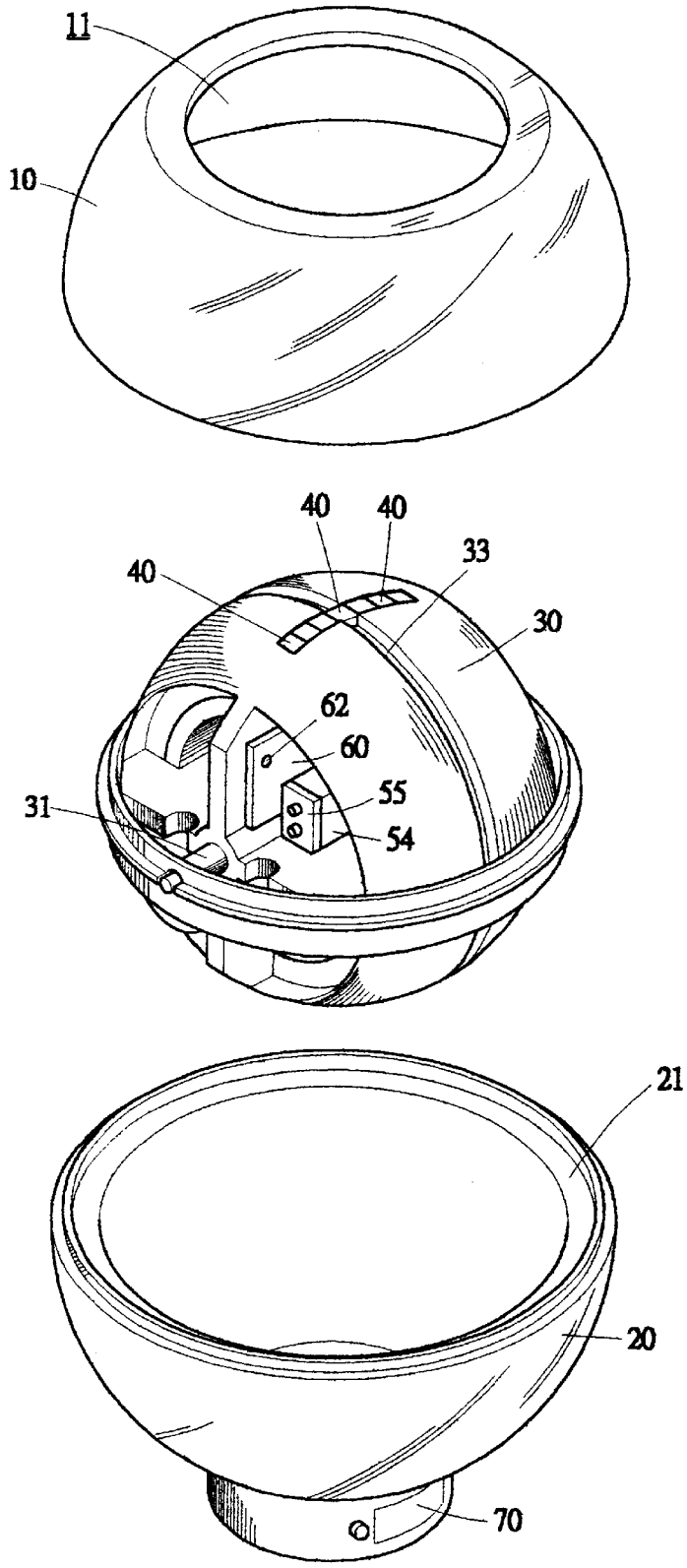
FIG. 5 is an exploded view of FIG. 4.

FIGS. 4 and 5 show a wrist exerciser constructed in accordance with a second embodiment of the present invention. For simplicity, the wrist exerciser of the second embodiment is also designated with reference numeral 100. The wrist exerciser 100 of the second embodiment is substantially identical to the wrist exerciser of the first embodiment except the power supply device or the power source Vcc that is provided by the generator 50 is replaced by a battery set 54 that is connected to the control circuit 60 by a switch 55. The switch 55 allows manual control of power supply to the control circuit 60 and the light emitting elements 40.

The wrist exerciser 100 of the second embodiment further comprises a counter 70 attached to the lower casing member 20 for counting and displaying the number of turns that the rotor 30 makes. The counter 70 may be powered by the power source Vcc of the wrist exerciser 100, but is preferably powered by an additional and independent power source (not shown). The arrangement of the independent power source of the counter 70 allows the counter 70 to be incorporated in any conventional wrist exerciser without significant modification of the conventional wrist exerciser.

It is apparent to those having ordinary skills to combine the dynamic power source provided by the generator 50 of the first embodiment and the static power source provided by the battery set 54 of the second embodiment whereby a wrist exerciser according to the present invention may comprise a power source that is a combination of an electrical generator and a battery set. In this case, the battery set may comprise secondary batteries which may be charged when the electrical generator provides excessive power. The battery set may then discharge to power the light emitting elements 40 when the rotor 30 is not in rotation.

Figure 6:
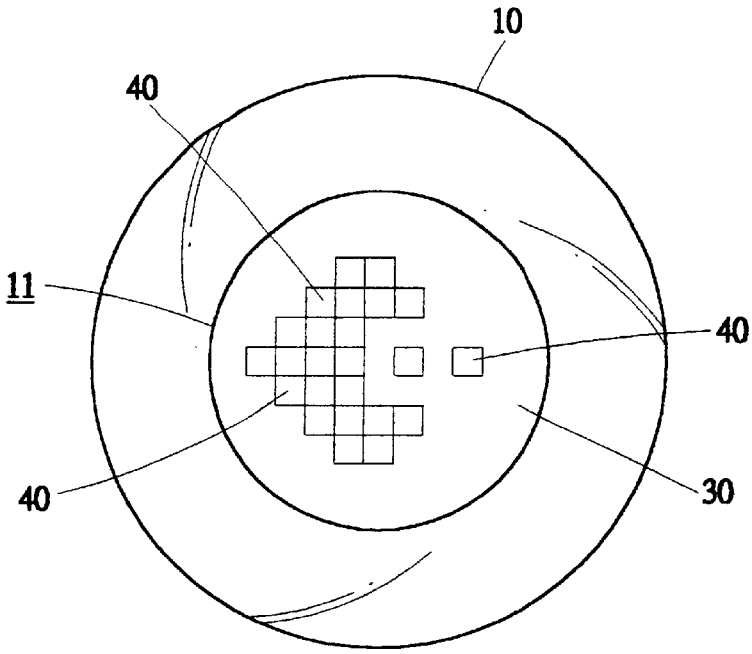
FIG. 6 is a schematic top view showing a first example of a pattern displayed by a message display of the wrist exerciser of the present invention.
Figure 7:
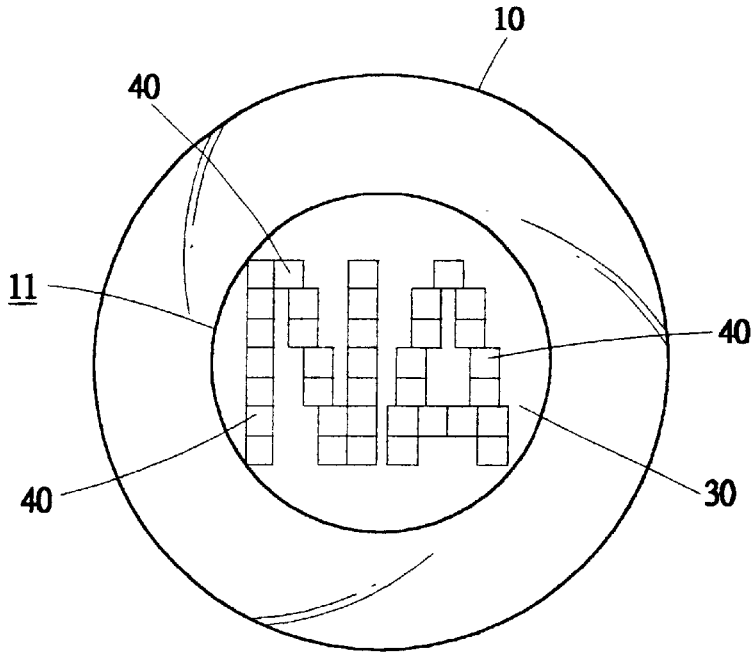
FIG. 7 is also a schematic top view showing a second example of a message displayed by the message display of the wrist exerciser of the present invention.

FIGS. 6 and 7 show two examples of displaying patterns or messages by the light emitting elements 40 in accordance with the present invention. FIG. 6 shows a pattern formed by lightening selected ones of the light emitting elements 40 at selected times when the rotor 30 may not be rotating. The lightening operation is controlled by the microprocessor 61 with a precise calculation of the lightening times based on the rotational speed of the rotor 30. In case the rotor 30 is rotating, due to the persistency of vision of the viewer's eyes, a stationary pattern such as that shown in FIG. 6 may be readily formed.

FIG. 7 shows the situation of displaying a train of moving characters which are formed with the same principle of FIG. 6 by precisely calculating the lightening times of the selected light emitting elements 40. By making use of the persistency of human vision, a very limited number of light emitting elements 40 is required in displaying a variety of complicated patterns or messages.

Figure 8:
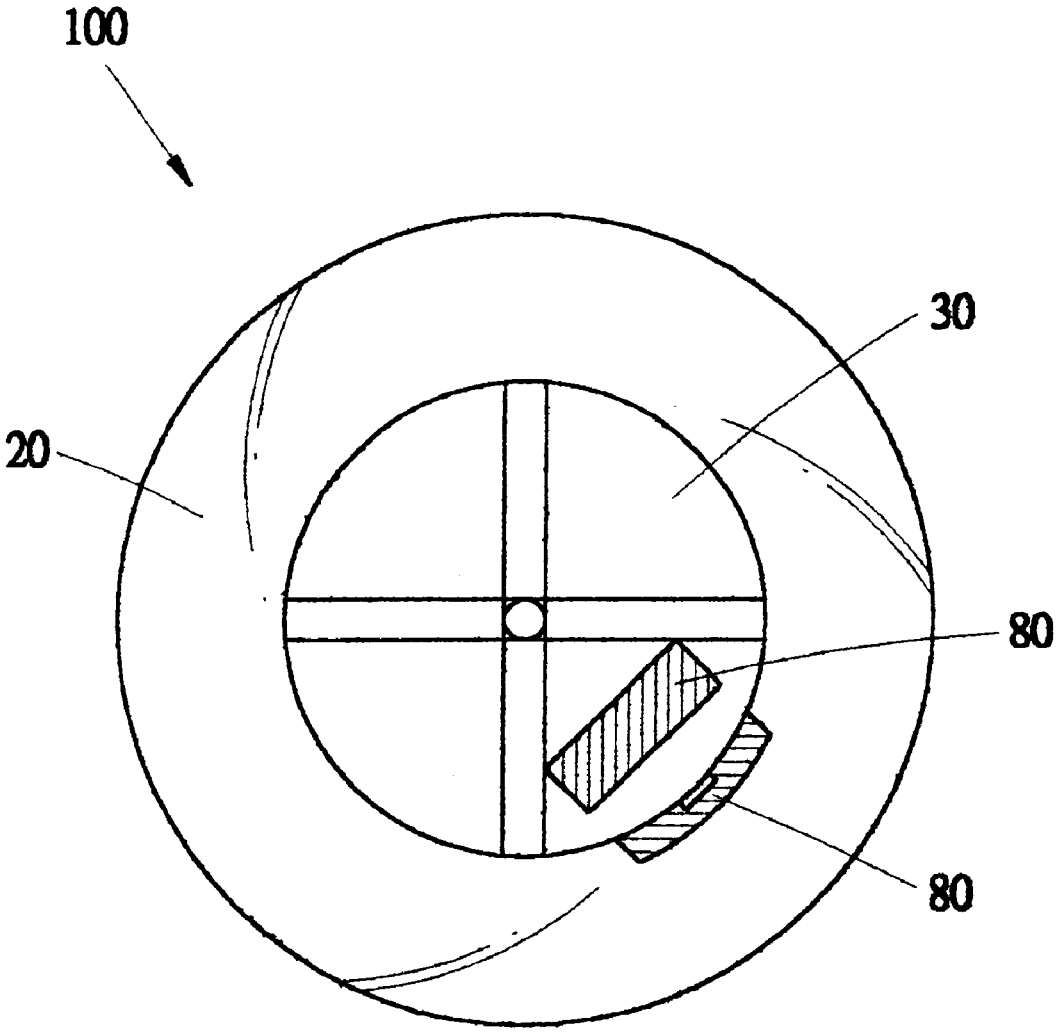
FIG. 8 is a schematic bottom view showing a wrist exerciser constructed in accordance with a third embodiment of the present invention.
Figure 9:
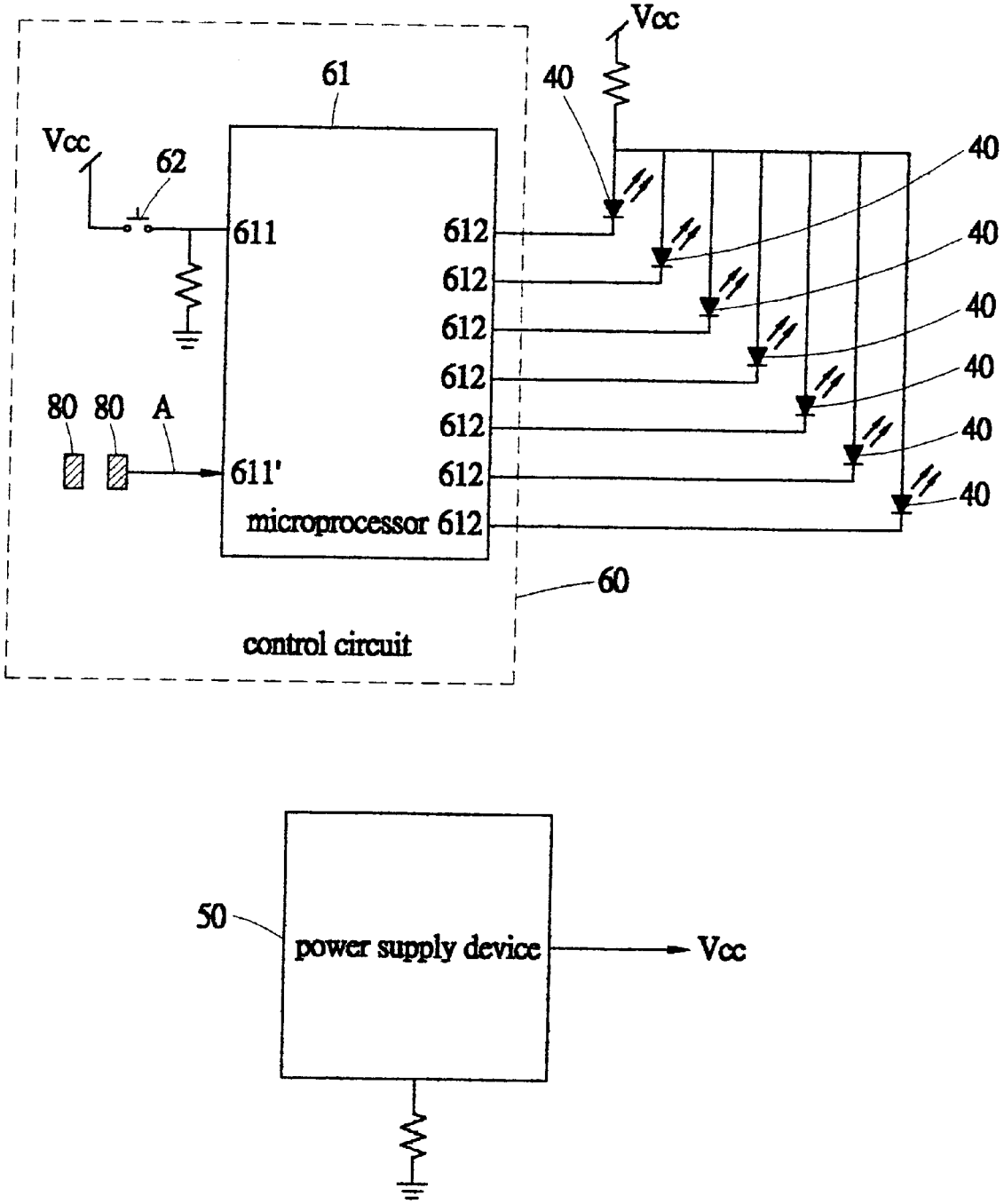
FIG. 9 is a block diagram of a control circuit of the wrist exerciser in accordance with the third embodiment of the present invention.

FIGS. 8 and 9 shows a wrist exerciser in accordance with a third embodiment of the present invention. The wrist exerciser of the third embodiment is also designated with reference numeral 100 for simplicity. The wrist exerciser 100 of the third embodiment is substantially identical to that of the first embodiment and further comprises sensor means 80 comprising first and second portions respectively mounted to the spherical casing (either the upper casing member 10 or the lower casing member 20) and the rotor 30. The sensor means 80 is arranged to generate a signal A to an additional input terminal 611' of the microprocessor 61 each time when the first and second portions of the sensor means 80 pass and face each other. In other words, in the example illustrated, the signal A is generated each time the rotor 30 makes a full turn. It is of course possible to mount more sensors in the wrist exerciser 100.

The signal A can be used to control the operation of the control circuit 60 for determining for example the timing of lightening the light emitting elements 40. For example, based on the signal A applied to the microprocessor 61, the control circuit 60 may turn on the light emitting elements 40 only when they are passing through the opening 11 of the upper cover member 10 for easy observation of the message displayed to the viewer. The light emitting elements 40 are turned off after they leave the opening 11. This may reduce overall power consumption of the wrist exerciser 100.

The generation of the signal A also allows the microprocessor 61 to calculate the rotational speed of the rotor 30. The rotational speed can then be displayed by means of the light emitting elements 40. The counter and display device 70 that is discussed with reference to the second embodiment can thus be omitted.

The sensor means 80 can be any suitable sensing devices, such as reed switches and photo switches. A device comprising a magnet and an induction coil may also be employed as the sensor means 80 for on of the signal A.

Alternatively, the frequency of the electricity generated by the generator 50 can also be used to calculate the rotational speed of the rotor 30. Such a calculation can be easily done by a suitably programmed microprocessor 61.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A wrist exerciser comprising:

a spherical casing;

a window formed on the casing;

a rotor having an outer surface and supported in the casing for rotation about a rotational axis;

a plurality of light emitting elements mounted to the outer surface of the rotor in at least one linear array, each of the at least one linear array being disposed substantially parallel to the rotational axis of the rotor to pass transversely through the window of the casing;

a power supply device for supply of electrical power to drive the light emitting elements; and a control circuit connected between the power supply device and the plurality of light emitting elements for selectively illuminating each of the plurality of light emitting elements into a plurality of linear illumination patterns, the plurality of linear illumination patterns being displayed in rapid succession when the plurality of light emitting elements is within the window of the casing.

2. The wrist exerciser as claimed in claim 1, wherein the casing forms an opening functioning as the window.

3. The wrist exerciser as claimed in claim 2, wherein the rotor forms a circumferential groove in the outer surface thereof and wherein the wrist exerciser further comprises a rope extending through the opening to be received in the groove and wound around the rotor whereby by manually pulling to unwind the rope, the rotor is rotated in the casing.

4. The wrist exerciser as claimed in claim 1, wherein a flange is formed on an inner surface of the casing for supporting a support ring, diametrically opposite holes being defined in the ring, and where the rotor comprises a shaft having two ends rotatably received and retained in the holes.

5. The wrist exerciser as claimed in claim 1, wherein each of the plurality of light emitting elements includes a light emitting diode.

6. The wrist exerciser as claimed in claim 1, wherein the power supply device comprising:

a magnet fixed inside the casing to generate magnetic lines of force; and at least a coil attached to the rotor whereby when the rotor is rotating, the coil cuts through the magnetic lines of force to induce an electrical current therein.

7. The wrist exerciser as claimed in claim 6, wherein the power supply device further comprises a regulation circuit.

8. The wrist exerciser as claimed in claim 1, wherein the power supply device comprises a battery set.

9. The wrist exerciser as claimed in claim 8, wherein the power supply device comprises a switch to control power supply from the battery set.

10. The wrist exerciser as claimed in claim 1, wherein the control circuit comprises a programmable control unit.

11. The wrist exerciser as claimed in claim 10, wherein the programmable control unit comprises a microprocessor having output terminals respectively connected to the plurality of light emitting elements.

12. The wrist exerciser as claimed in claim 1 further comprising sensing means comprising first and second portions respectively mounted to the rotor and the casing for generating a signal each time the first and second portions pass each other during the rotation of the rotor, and wherein the control circuit comprises a microprocessor having a signal input terminal for receiving the signal of the sensing means and output terminals respectively connected to the plurality of light emitting elements for selectively illuminating each of the plurality of light emitting elements into the plurality of linear illumination patterns.

13. The wrist exerciser as claimed in claim 12, wherein the microprocessor is programmed to selectively illuminate each of the plurality of light emitting elements in accordance with at least two operation modes, the control circuit comprising a switch connected to the microprocessor for selection of the operation modes.

14. The wrist exerciser as claimed in claim 11, wherein the microprocessor is programmed to selectively illuminate each of the plurality of light emitting elements in accordance with at least two operation modes, the control circuit comprising a switch connected to the microprocessor for selection of the operation modes.

15. The wrist exerciser as claimed in claim 12, wherein the sensing means comprises a reed switching device.

16. The wrist exerciser as claimed in claim 12, wherein the sensing means comprises a photo switch device.

17. The wrist exerciser as claimed in claim 12, wherein the sensing means comprises a magnet and an induction coil.

18. The wrist exerciser as claimed in claim 1, wherein the plurality of linear illumination patterns are displayed in rapid succession as the plurality of light emitting elements traverses, in rotation with the rotor, the window of the casing.

* * * * *